US007674096B2

(12) United States Patent
Sundheim

(10) Patent No.: US 7,674,096 B2
(45) Date of Patent: Mar. 9, 2010

(54) PORTABLE, ROTARY VANE VACUUM PUMP WITH REMOVABLE OIL RESERVOIR CARTRIDGE

(76) Inventor: Gregroy S. Sundheim, 5170 Juniper St., Bowmar, CO (US) 80123

( * ) Notice: Subject to any disclaimer, the term of this patent is extended or adjusted under 35 U.S.C. 154(b) by 657 days.

(21) Appl. No.: 10/947,899

(22) Filed: Sep. 22, 2004

(65) Prior Publication Data

US 2006/0073033 A1 Apr. 6, 2006

(51) Int. Cl.
*F04B 53/00* (2006.01)

(52) U.S. Cl. ..... 417/234; 418/100

(58) Field of Classification Search ..... 417/234, 417/310, 410.1; 418/100, 259, 85, 101
See application file for complete search history.

(56) References Cited

U.S. PATENT DOCUMENTS

| | | | | |
|---|---|---|---|---|
| 235,905 | A | 12/1880 | Schultz | |
| 2,476,041 | A * | 7/1949 | Happe et al. | 418/90 |
| 2,491,351 | A | 12/1949 | Zeitlin | |
| 3,008,631 | A * | 11/1961 | Paugh | 418/13 |
| 3,067,624 | A | 12/1962 | Norton et al. | |
| 3,191,503 | A | 6/1965 | Fuehrer | |
| 3,451,276 | A | 6/1969 | Wadlow et al. | |
| 3,670,190 | A * | 6/1972 | Goebel | 310/60 R |
| 3,744,942 | A * | 7/1973 | Mount | 418/76 |
| 3,820,924 | A | 6/1974 | Cassidy | |
| 3,834,840 | A | 9/1974 | Hartley | |
| 3,837,764 | A * | 9/1974 | Fritch et al. | 417/62 |
| 3,952,709 | A | 4/1976 | Riddel | |
| 3,990,819 | A | 11/1976 | Ritchie | |
| 4,032,270 | A | 6/1977 | Sheth et al. | |
| 4,283,167 | A * | 8/1981 | Bassan et al. | 418/13 |
| 4,299,097 | A | 11/1981 | Shank et al. | |
| 4,408,968 | A | 10/1983 | Inagaki et al. | |
| 4,447,196 | A * | 5/1984 | Nagasaku et al. | 418/93 |
| 4,523,897 | A * | 6/1985 | Lower et al. | 417/244 |
| 4,559,838 | A | 12/1985 | Neuenschwander | |
| 4,608,002 | A | 8/1986 | Hayase et al. | |
| 4,631,006 | A | 12/1986 | Murray | |
| 4,921,071 | A * | 5/1990 | Lonnborg et al. | 184/6.4 |

(Continued)

OTHER PUBLICATIONS

Stinger 2000 —Universal Refrigerant Recovery System, pp. 4-5 and 16, 2000, United Kingdom.

(Continued)

*Primary Examiner*—Devon C Kramer
*Assistant Examiner*—Peter J Bertheaud
(74) *Attorney, Agent, or Firm*—W. Scott Carson

(57) ABSTRACT

A portable, rotary vane vacuum pump with a rotor eccentrically mounted within the bore of a housing to substantially abut the bore at a side location. The abutting, side location is between the inlet and outlet passages of the bore in the direction of rotor rotation. A pocket is then created just above the contact area between the rotor and bore which collects and maintains a pool of lubricating oil. The pool enhances the seal at the contact area below it enabling the pump to draw a deep vacuum with just a single stage. The portable pump also includes a removable, oil reservoir cartridge mounted to the main body of the pump. Other features include a visual indicator in the cartridge to monitor the condition of the circulating oil, a step up gearing arrangement for the cooling fan, and a step down gearing arrangement for the vane pump.

13 Claims, 11 Drawing Sheets

U.S. PATENT DOCUMENTS

| | | | | |
|---|---|---|---|---|
| 5,017,108 | A | | 5/1991 | Murayama et al. |
| 5,078,017 | A | | 1/1992 | Zornes |
| 5,092,185 | A | | 3/1992 | Zornes et al. |
| 5,127,239 | A | | 7/1992 | Manz et al. |
| 5,310,326 | A | * | 5/1994 | Gui et al. ..... 418/76 |
| 5,846,059 | A | | 12/1998 | Mizuno et al. |
| 6,099,259 | A | | 8/2000 | Monk et al. |
| 6,126,410 | A | | 10/2000 | Kung et al. |
| D474,209 | S | | 5/2003 | Seymour et al. |
| D482,373 | S | | 11/2003 | Seymour et al. |

OTHER PUBLICATIONS

Oz Refrigerant Recovery System—Powermax, ThermaFlo, Springfield, MA,, 2003.

Welch Direct Drive Vacuum Pumps, 2003, Labconco Corporation, Kansas City, MO.

CPS 2003—Professional Air Conditioning & Refrigeration Products, 2003, p. 14, CPS Products, Inc., Hialeah, FL.

Promax Robinair, ATP 2004 HVAC/R Catalog, pp. 22-23, Advanced Test Products, Miramar, FL.

Greg Sundheim, Helpful Hints for Refrigerant Recovery, Contracting Business, Feb. 1997, Penton Publishing Inc., Cleveland, OH.

Refrigerant Recovery, 1998, Promax/Amprobe, Englewood, CO.

Stinger 2000—Universal Refrigerant Recovery System, pp. 4-5 and 16.

Oz Refrigerant Recovery System—Powermax, ThermaFlo, Springfield, MA.

Welch Direct Drive Vacuum Pumps, 6 page brochure 2003.

Once Through Oil Sealed System [online]. Beach-Russ [retrieved on Nov. 16, 2007]. Retrieved from the Internet: <URL:http://www.beach-russ.com/oilsealed.htm>.

* cited by examiner

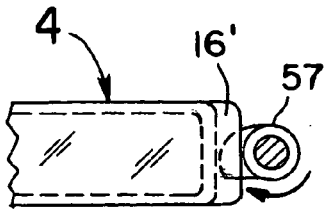
Fig. 9
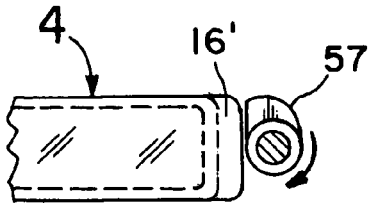
Fig. 10
Fig. 11
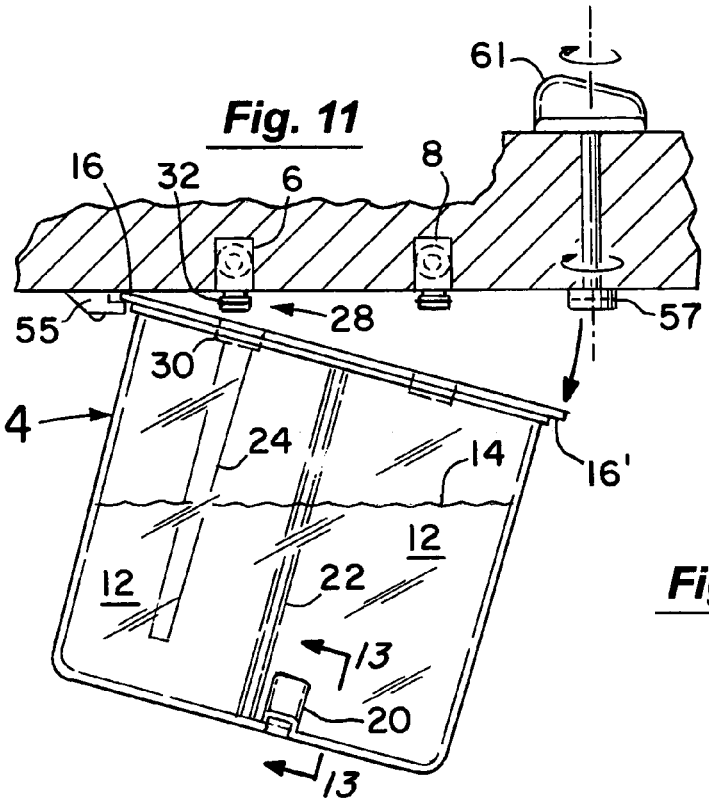
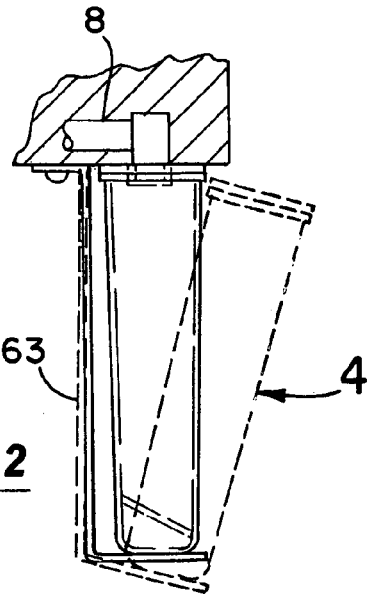
Fig. 12
Fig. 13
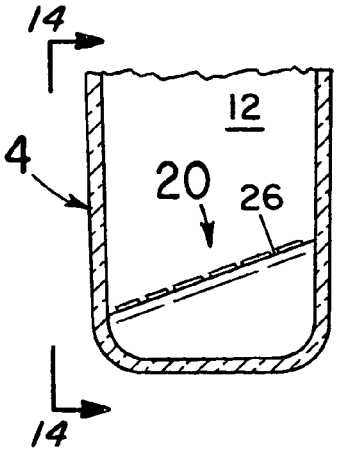
Fig. 14
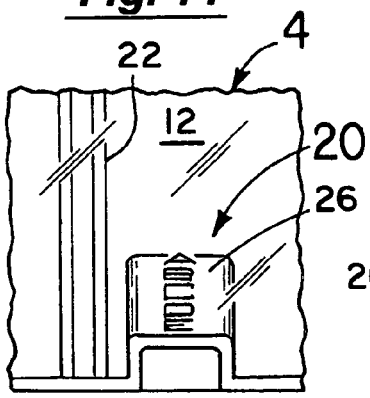
Fig. 15
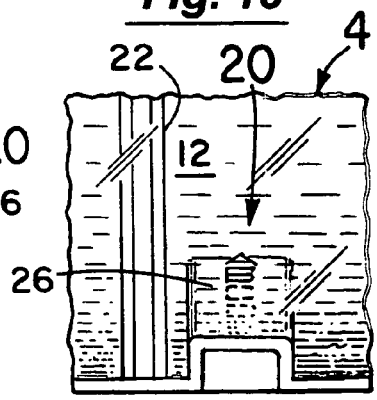

PORTABLE, ROTARY VANE VACUUM PUMP WITH REMOVABLE OIL RESERVOIR CARTRIDGE

BACKGROUND OF THE INVENTION

1. Field of the Invention

This invention relates to the field of portable, rotary vane vacuum pumps and more particularly to the field of such pumps for use in servicing air conditioning and refrigeration systems.

2. Discussion of the Background

Portable, rotary vane vacuum pumps are widely used in the servicing of air conditioning and refrigerant systems to draw down a relatively deep vacuum before the system is recharged. In a typical servicing procedure, the refrigerant of the system is first recovered and the unit opened to atmosphere for repairs. Thereafter and prior to recharging it, the air and any residual moisture much be pulled out of the system otherwise its performance will be adversely affected. More specifically, any air and moisture left in the system will interfere with the refrigerant's thermal cycle causing erratic and inefficient performance. Additionally, any residual air and moisture can cause undesirable chemical reactions within the system components and form ice crystals within the system contributing to accelerated component failures.

The optimum operation of the vacuum pump used in such servicing is very important in order to draw as deep a vacuum as possible. Chief among the factors affecting its efficiency is the condition of the lubricating and sealing oil. Good service practices and most vacuum pump manuals call for the vacuum pump oil to be changed with every use. This frequent changing of the oil is recommended as it will quickly becomes laden with residual contaminants from the system and atmospheric moisture. These in turn lead to the inability of the vacuum pump to achieve a proper depth of vacuum to adequately pull air and moisture out of the system prior to recharging it.

In the field, the vacuum pump oil is rarely changed in the prescribed intervals or even when desirable because of the task's inherent mess and inconvenience. In most designs, the pump is submerged or at least partly submerged in an oil bath or sump for lubrication, sealing, and heat dissipation purposes. To change the oil, the sump must then be gravity drained or flushed and fresh oil poured into it. This can be a very time consuming and labor intensive procedure.

As an alternative to changing the oil for each use or at timed intervals, many pumps are commonly provided with a sight glass to allow the operator to view the level of the oil in the sump and monitor its condition. However, the sight glass in most cases becomes fouled and darken over time by a film of used oil making the viewing through it very difficult if not impossible. Consequently, the operator is really not able to truly monitor the level of the oil in the sump or its condition to decide if any servicing is needed.

With this and other problems in mind, the present invention was developed. In it, a rotary vane pump is disclosed that can draw a deep vacuum even with a single stage. Additionally, the pump is provided with a removable oil reservoir cartridge wherein the oil for the pump can be easily and quickly changed by simply removing and replacing the cartridge.

SUMMARY OF THE INVENTION

This invention involves a portable, rotary vane vacuum pump. The pump includes a rotor eccentrically mounted within the bore of a housing to substantially abut or contact the bore at a side location. The abutting, side location is between the inlet and outlet passages of the bore in the direction of rotor rotation. In this manner, a pocket is created just above the contact area between the rotor and bore which collects and maintains a pool of lubricating oil. The pool of oil enhances the seal at the contact area below it and enables the pump to draw a deep vacuum with just a single stage.

The portable pump of the present invention also includes a removable, oil reservoir cartridge mounted to the main body of the pump. The cartridge initially holds a fresh supply of lubricating oil and can be easily and quickly attached to the pump. As the pump is run, the lubricating oil circulates between the pump and the cartridge. The cartridge includes a sump portion and once the job is done, the cartridge including the used oil in the sump portion can be removed as a unit and replaced with a fresh cartridge. Other features of the present invention include a visual indicator in the cartridge to monitor the condition of the circulating oil, a step up gearing arrangement for the cooling fan, and a step down gearing arrangement for the vane pump.

BRIEF DESCRIPTION OF THE DRAWINGS

FIG. 9 is a view taken along line 9-9 of FIG. 8 showing the eccentric locking piece for the oil reservoir cartridge.

FIG. 10 is a view similar to FIG. 9 but with the eccentric locking piece in an open position.

FIG. 11 illustrates one manner in which the oil reservoir cartridge can be manually removed from the main body of the pump.

FIG. 12 illustrates a second manner in which the oil reservoir cartridge can be manually removed from the main body of the pump.

FIG. 13 is a view taken along line 13-13 of FIG. 11.

FIGS. 14 and 15 illustrate the operation of a visual indicator in the reservoir cartridge that can be used to monitor the condition of the oil.

DETAILED DESCRIPTION OF THE INVENTION

Figure 1:
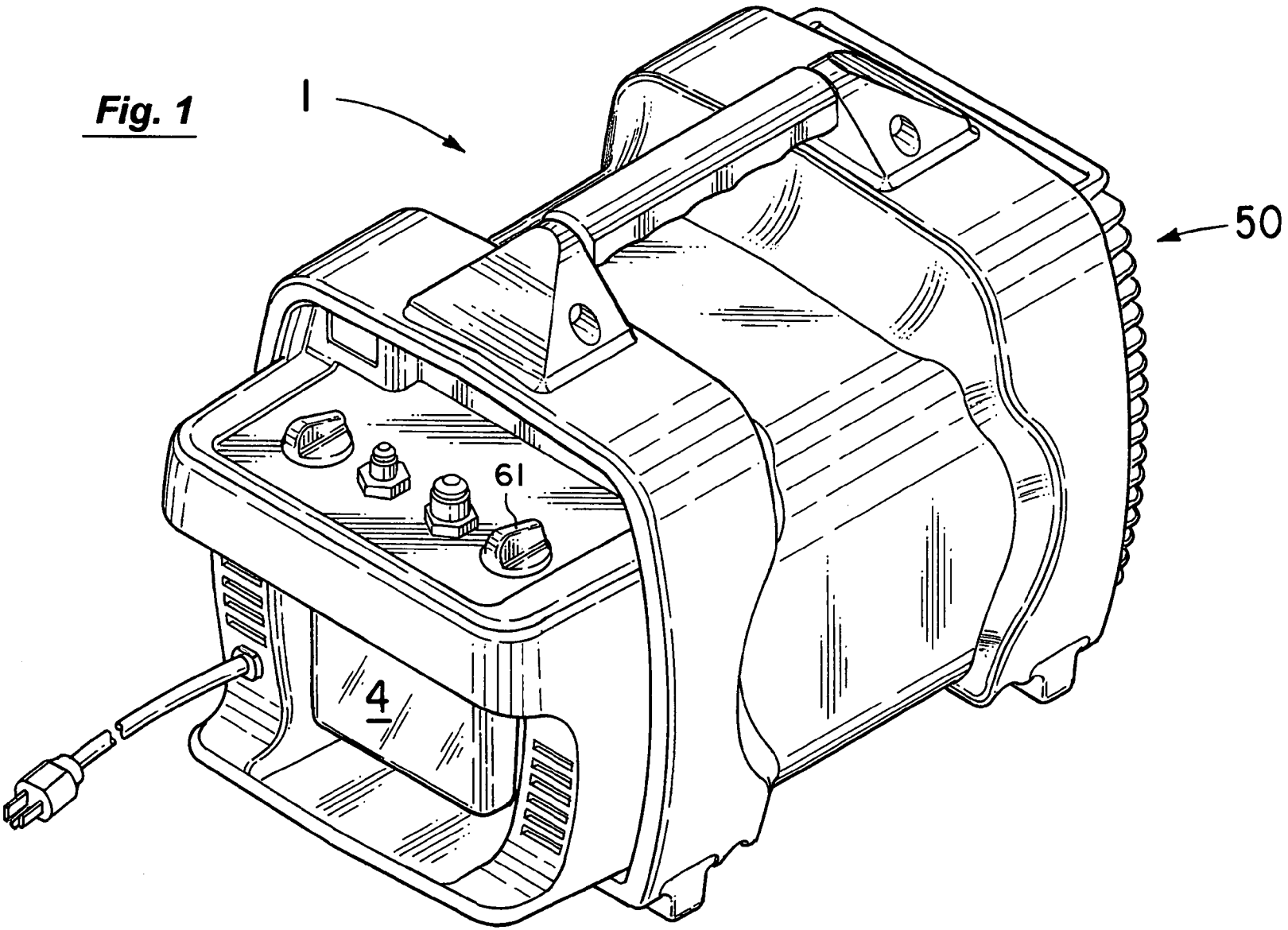
FIG. 1 is a perspective view of the portable, rotary vane pump of the present invention.
Figure 2:
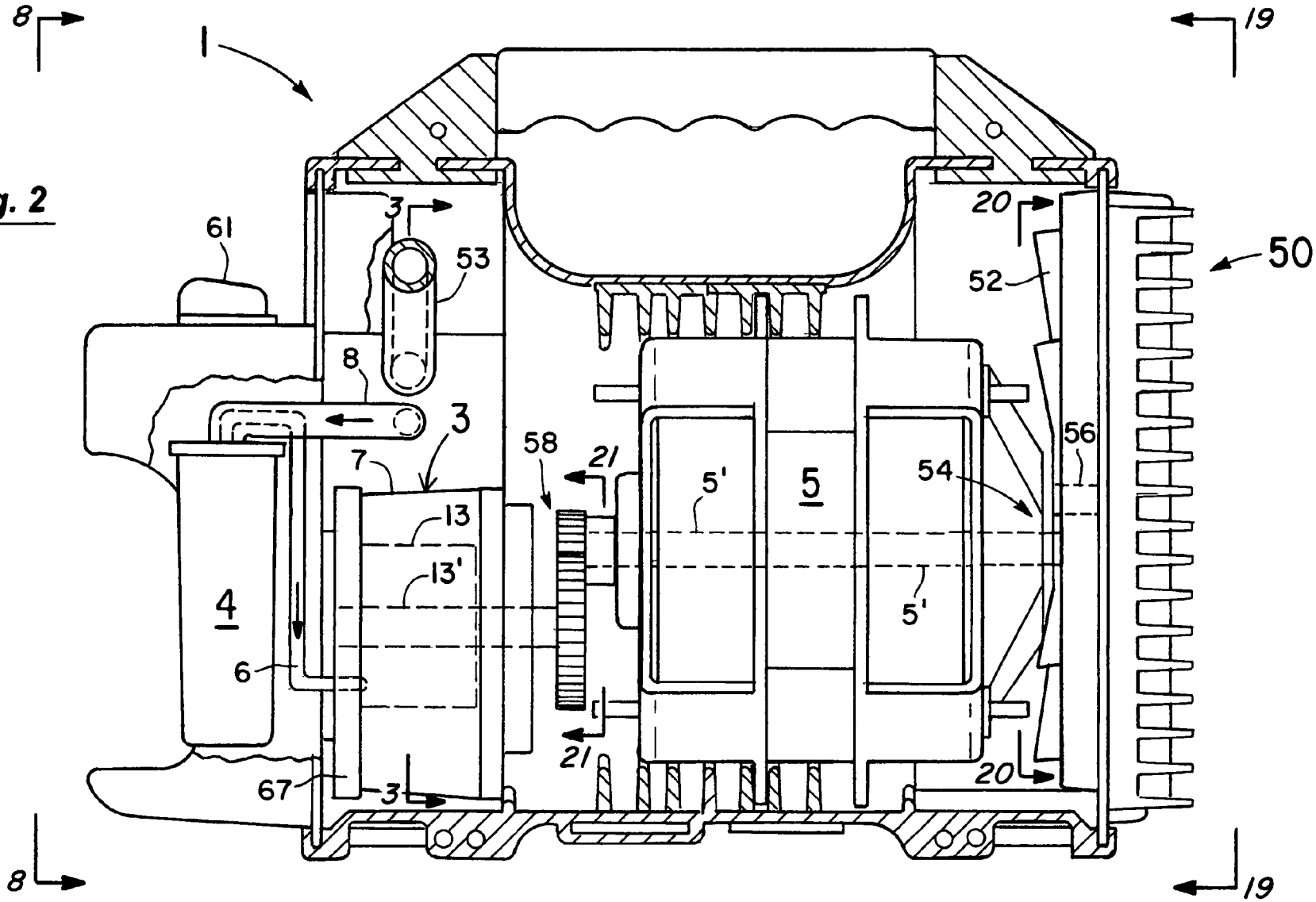
FIG. 2 is a partial cross-sectional view of the portable pump.
Figure 3:
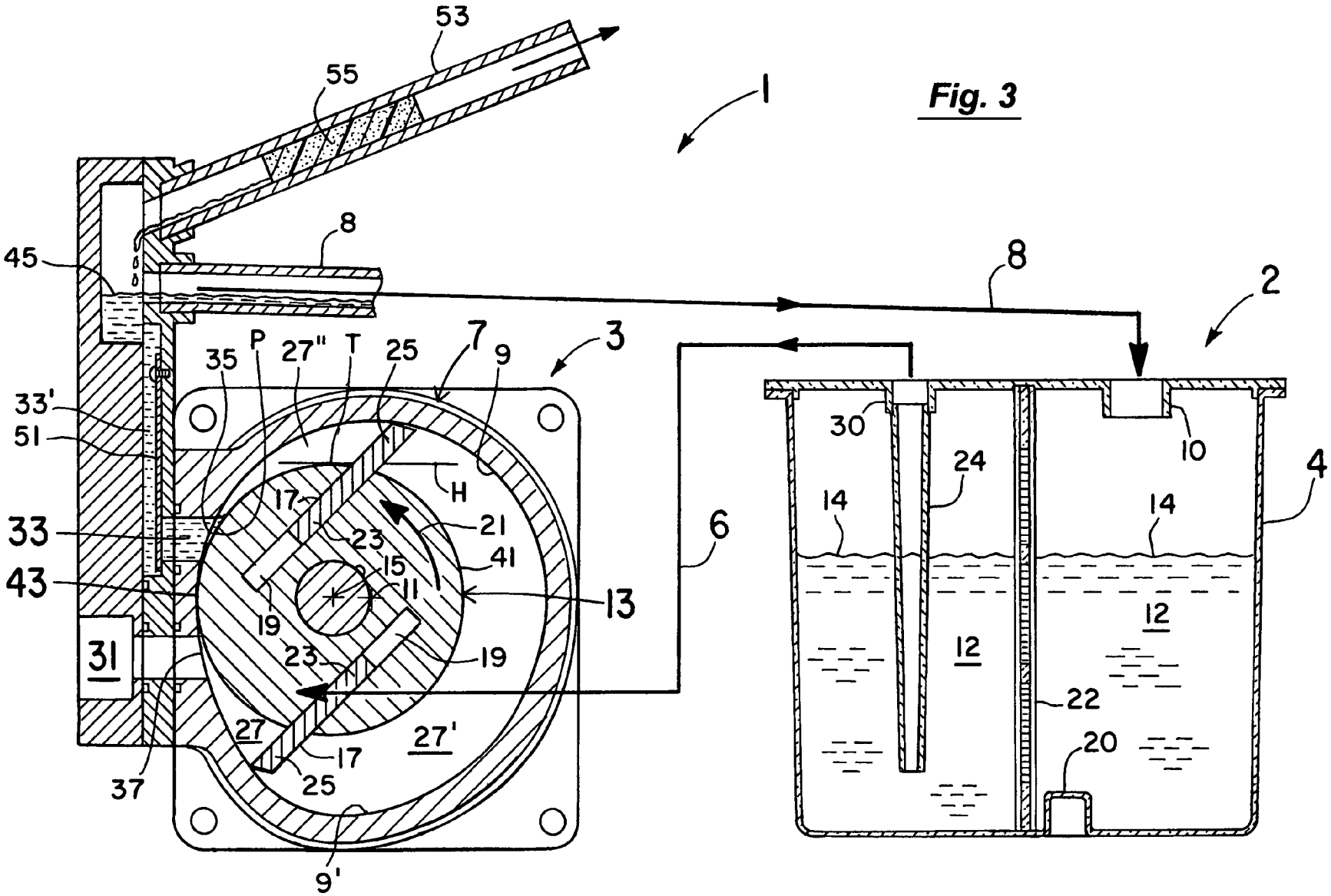
FIG. 3 is a view taken along line 3-3 of FIG. 2 of the rotary vane pump with a schematic showing of the lubricating oil system.
Figure 5:
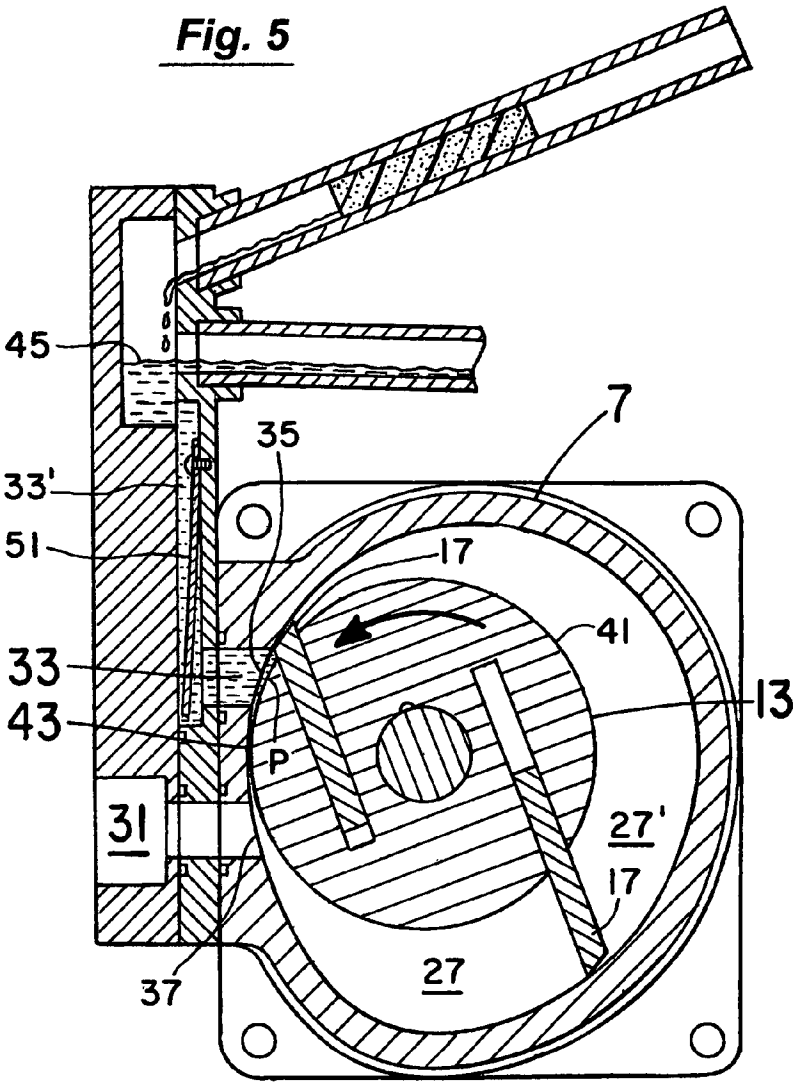
FIGS. 4-7 taken with FIG. 3 sequentially illustrate the operation of the rotary vane pump.

As illustrated in FIGS. 1 and 2, the pump 1 of the present invention is a portable unit and includes a rotary vane, vacuum pump 3 (see FIGS. 2 and 3) driven by the electric motor 5. The vane pump 3 as best seen in FIG. 3 (which is a cross-sectional view taken along line 3-3 of FIG. 2) has a housing 7 with an inner surface 9 extending about the axis 11 to define in part a bore. The inner surface 9 as shown extends asymmetrically about the axis 11 with a substantially elliptical section at 9' but could extend symmetrically about the axis 11 if desired. Regardless, the rotor 13 of the pump 1 is mounted within the bore (FIG. 3) for rotation about the axis 15. The axis 15 as illustrated is offset from and substantially parallel to the housing axis 11. The rotor 13 also includes at least two vanes 17 mounted for sliding movement within the respective slots 19.

In operation, the motor 5 of FIG. 2 rotates the rotor 13 in a first direction 21 (FIG. 3) about the axis 15 within the bore of the housing 7. In this regard, each vane 17 of the rotor 13 has an inner 23 and outer 25 edge portion. The outer edge portions 25 contact the inner surface 9 of the housing 7 due to the centrifugal forces developed as the rotor 13 is rotated by the motor 5 about the axis 15. The vanes 17 then separate the bore of the housing 7 into a plurality of chambers 27, 27', and 27" as shown.

The housing 7 of FIG. 3 further includes at least one inlet passage 31 and at least one outlet passage 33 through the inner surface 9. The passages 31 and 33 are respectively in fluid communication with the bore of the housing 7. The outlet passage 33 as shown in FIG. 3 passes through the inner surface 9 of the housing 7 at a first location or port 35 about the axis 11. The inlet passage 31 as also illustrated in FIG. 3 passes through the inner surface 9 of the housing 7 at a second location or port 37 about the axis 11. The second location 37 is spaced from the first location 35 of the outlet passage 31 about the axis 11 in the rotational direction 21 of the rotor 13.

The rotor 13 is substantially cylindrical with a substantially cylindrical outer surface 41 (FIG. 3) extending about the rotor axis 15. The cylindrical outer surface 41 as shown substantially abuts the inner surface 9 of the housing 7 at a third location 43 about the axis 11. The abutting, third location 43 is positioned between the first and second locations or ports 35,37 of the outlet and inlet passages 33,31.

The pump 1 of the present invention as schematically shown in FIG. 3 has a lubricating oil system 2. The system 2 includes an oil reservoir cartridge 4, an oil inlet arrangement schematically shown at 6 to supply oil from the reservoir cartridge 4 to the bore of the housing 7, and an oil return arrangement 8 to deliver oil back from the bore of the housing 7 to the reservoir cartridge 4.

The cylindrical outer surface 41 of the rotor 13 as shown in FIG. 3 extends upwardly to a substantially horizontal plane H. The plane H is substantially tangent at location T to the cylindrical outer surface 41. The outlet passage 33 of the housing 7 at the first location or port 35 in FIG. 3 then passes through the inner surface 9 of the housing 7 below the horizontal plane H. At the first location or port 35, the upper section of the outlet passage 33 (FIG. 3) is spaced from the cylindrical outer surface 41 of the rotor 13. In this manner, a pocket area P is created between the cylindrical outer surface 41 of the rotor 13 and the first location or port 35 of the outlet passage 33. Further, the outlet passage 33 as shown extends away from the inner surface 9 of the housing 7 and upwardly at 33' to a fourth location 45 above the first location or port 35.

As explained in more detail below, oil supplied by the inlet arrangement 6 from the reservoir cartridge 4 to the bore of the housing 7 in FIG. 3 collects in and substantially fills the outlet passage 33. This outlet passage 33 including its upwardly extending portion 33' is preferably filled from the first location or port 35 to the fourth location 45. Additionally as also explained in more detail below, oil substantially fills the pocket area P. This pocket area P as indicated above is formed between the cylindrical outer surface 41 of the rotor 13 and the outlet passage 33 at the first location or port 35. In this manner, a pool of oil is maintained in the pocket area P as the rotor 13 is rotated (see FIGS. 3-7). This pool of oil provides a supply of oil immediately above the critical sealing area 43 where the cylindrical outer surface 41 of the rotor 13 substantially abuts the inner surface 9 of the housing 7. A very tight seal is thereby created between the area 43 of the housing 7 and the cylindrical outer surface 41 and the outer edge portions 25 of the vanes 17 as surface 41 and vane portions 25 pass by the abutting area 43. The pool of oil in the pocket area P in essence provides a liquid seal above the area 43 as well as a liberal bath of oil for the cylindrical outer surface 41 and outer vane portions 25 as they pass toward the critical area 43. The vane pump 1 of the present invention is then able to draw a very deep vacuum (e.g., 50-150 microns of Mercury) with just the single stage arrangement illustrated in FIGS. 3-7.

Figure 4:
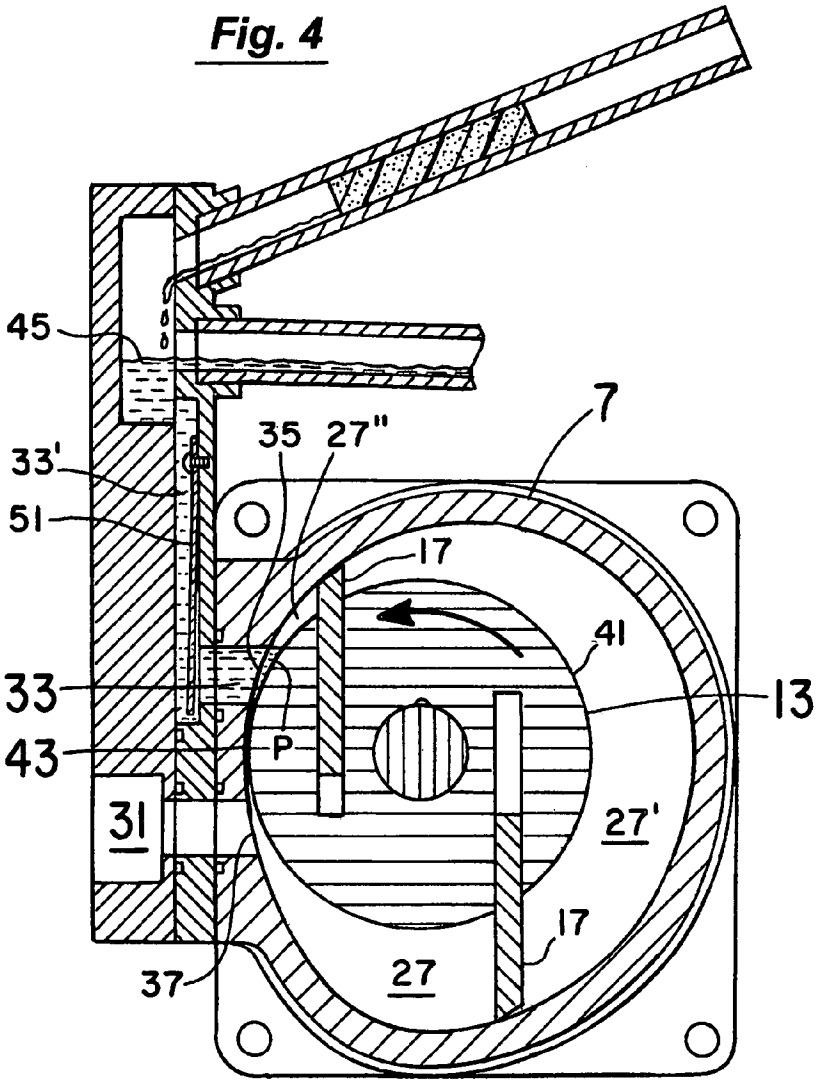
Figure 7:
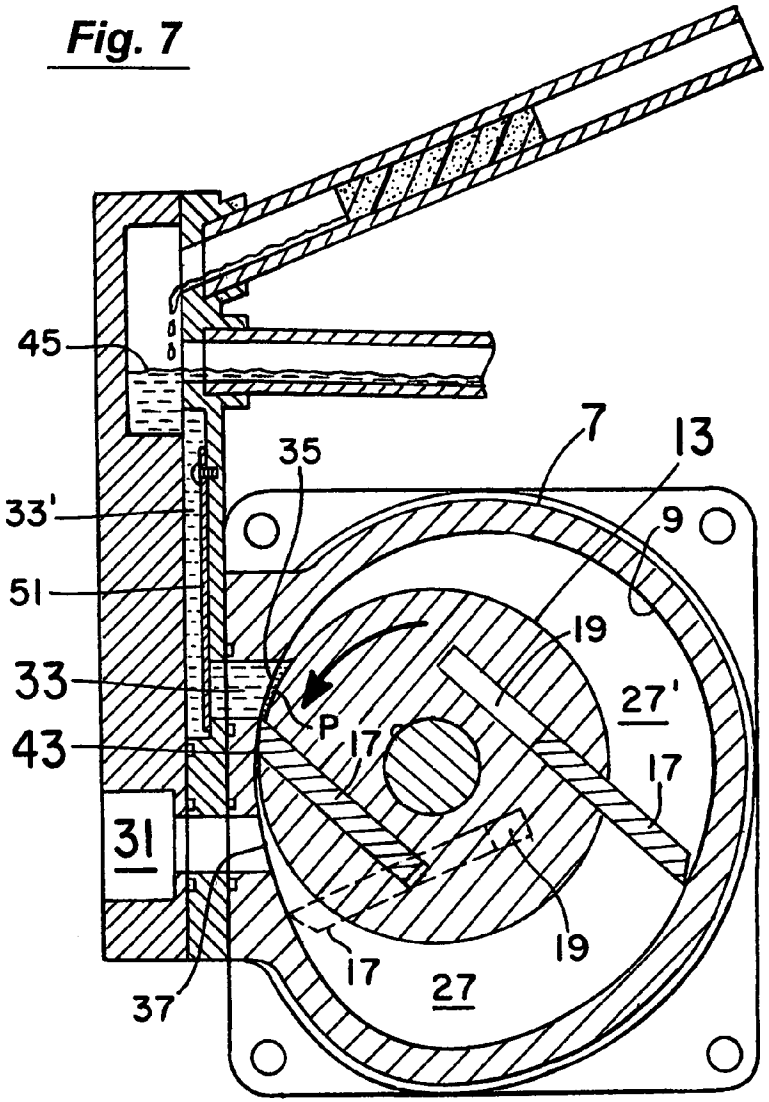
Figure 6:
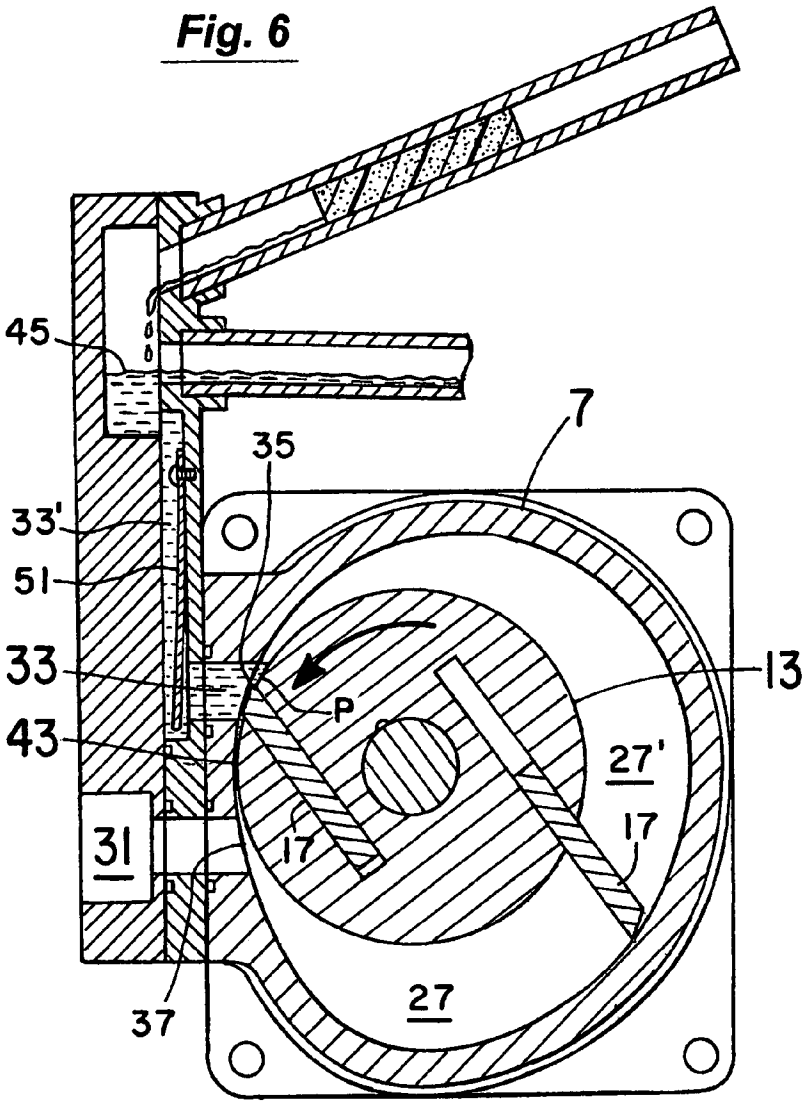

More specifically and referring to the sequential views of FIG. 3-7, the chamber 27 (FIG. 3) is progressively expanded (FIGS. 4-6) to draw in gases (e.g., air and water vapor) through the inlet passage 31 until the maximum vacuum is drawn substantially at the position of FIG. 7. The previously drawn in volume of gases of chamber 27' in FIG. 7 is then simultaneously compressed. The compression is accomplished as the rotor 13 and vanes 17 move to the position of FIG. 3 and on through the positions of FIGS. 4-6. In doing so, the compressed gases are forced through the liquid barrier of oil in the outlet passage 33 including its upwardly extending portion 33'. The liquid barrier of oil extends as illustrated in FIG. 4 from the first location or port 35 up to the fourth location at 45. The portion 33' in this regard may extend on the order of 2 inches vertically with the diameter of the passage 33 at port 35 being about ⅜ths of an inch or so.

A reed or flapper valve 51 (e.g., strip of spring steel) in FIGS. 3-7 serves to open and close the outlet passage 33 between the locations 35 and 45. The reed or similar valve 51 essentially vibrates or flaps in response to the pressure waves and volumes of gases and oil passing by the valve 51. In doing so, the gases gurgle or bubble through the oil in the pocket area P and the oil collected in the outlet passage 33 (including its upwardly extending portion 33'). Because of the head of oil in the outlet passage 33 (including its upwardly extending portion 33'), a collection or supply of oil remains in the outlet passage 33 and pocket area P as the rotor 13 rotates. This collection or pool as discussed above maintains a sealing supply of oil in the pocket area P just above the critical area 43. This collected oil as also discussed above liberally coats or lubricates the cylindrical outer surface 41 and outer vane edge portions 25 of the rotor 13 to create a very tight seal at the abutting area 43. The collected oil essentially serves to fill any gaps in the mechanical tolerances between the area 43 and the rotating parts of the rotor 13. This enhanced, tight seal in turn allows the pump 1 of the present invention to draw the deep vacuum (e.g., 50-150microns of Mercury) in the chamber 27 of FIG. 7 between the area 43 and vane 17 forming the chamber 27. The pump 1 can certainly be used with a second stage. However, even in harsh operating conditions, the single stage of pump 1 of the present invention will draw a deep enough vacuum (e.g., 500 microns) to boil off any moisture or other contaminates. This single stage is preferred over multiple stage pumps as it reduces the complexity and number of parts for assembly and service.

The abutting location or area 43 is illustrated in FIGS. 3-7 substantially at 90 degrees about the rotational axis 15 (FIG. 3) from the tangent location T. However, the location 43 could be closer to the tangent location T (e.g., spaced 30-60 degrees or fewer) as long as the pocket area P is maintained to collect oil. The location 43 could also be positioned past the 90 degree position if desired up to about 180 degrees, again as long as the pocket area P is maintained to collect oil above the location 43. The positioning of the location 43 at least about 90 or more degrees also offers the advantage that the vanes 17 do not have to be spring loaded in the slots 19. Rather, gravitational forces will enhance or add to the centrifugal forces driving the outer edge portions 25 of the vanes 17 outwardly against the inner surface 9 of the housing 7. As shown in dotted lines in FIG. 7, the gravitational assist occurs as the illustrated vane 17 moves downwardly from the location 43 and starts to form what will become the next chamber 27. In this regard, the vane 17 illustrated in dotted lines in FIG. 7 is directed with a downward component after or beyond the third location 43 wherein gravity assists the outward movement of the vane 17 into contact with the inner surface 9 of the housing 7. Although the vanes 17 are preferably free floating in the slots 19, springs or similar arrangements could be used in each slot 19 to bias each vane 17 outwardly. However, such springs tend to fatigue and fail over time leading to reduced pump efficiency and the need for servicing.

Referring back to FIG. 3 and as schematically shown, oil is continually being circulated from the reservoir cartridge 4 along the path 6 to the bore of the housing 7, through the outlet passage 33 (including it upwardly extending portion 33'), and back along the return line 8 to the reservoir cartridge 4. At the location 45 of the outlet passage 33 in FIG. 3, the gases passing through the outlet passage 33 and the oil therein substantially separate from the oil and pass out the exhaust pipe 53. The upwardly inclined, exhaust pipe 53 is in fluid communication with ambient air and in a known manner, baffle material 55 is provided in the exhaust pipe 53. The baffle material 55 separates any oil carried off with the gases and directs the oil back toward the location at 45 in FIG. 3.

From the location 45 which is in fluid communication with ambient air, the oil preferably flows by gravity along a downwardly inclined conduit 8 to the inlet 10 of the reservoir cartridge 4 and into the sump portion 12 of the reservoir cartridge 4. The inlet 10 in this regard preferably does not sealingly engage the conduit 8 wherein the inlet 10 and interior of the reservoir cartridge 4 above the oil level 14 in the sump portion 12 are in fluid communication with ambient air. Among other advantages, the fluid communication with ambient air of the reservoir cartridge inlet 10 and return line 8 eliminates the need for a ballast arrangement. In other designs with sealed sumps, such ballast arrangements are commonly needed to bleed in air at the last phase of the vacuum pump's operation to displace vapor laden with moisture or other contaminants from the oil sump. Otherwise, the moisture and contaminants of the vapor tend to mingle with the sump oil and reduce the overall efficiency of the pump.

Figure 8:
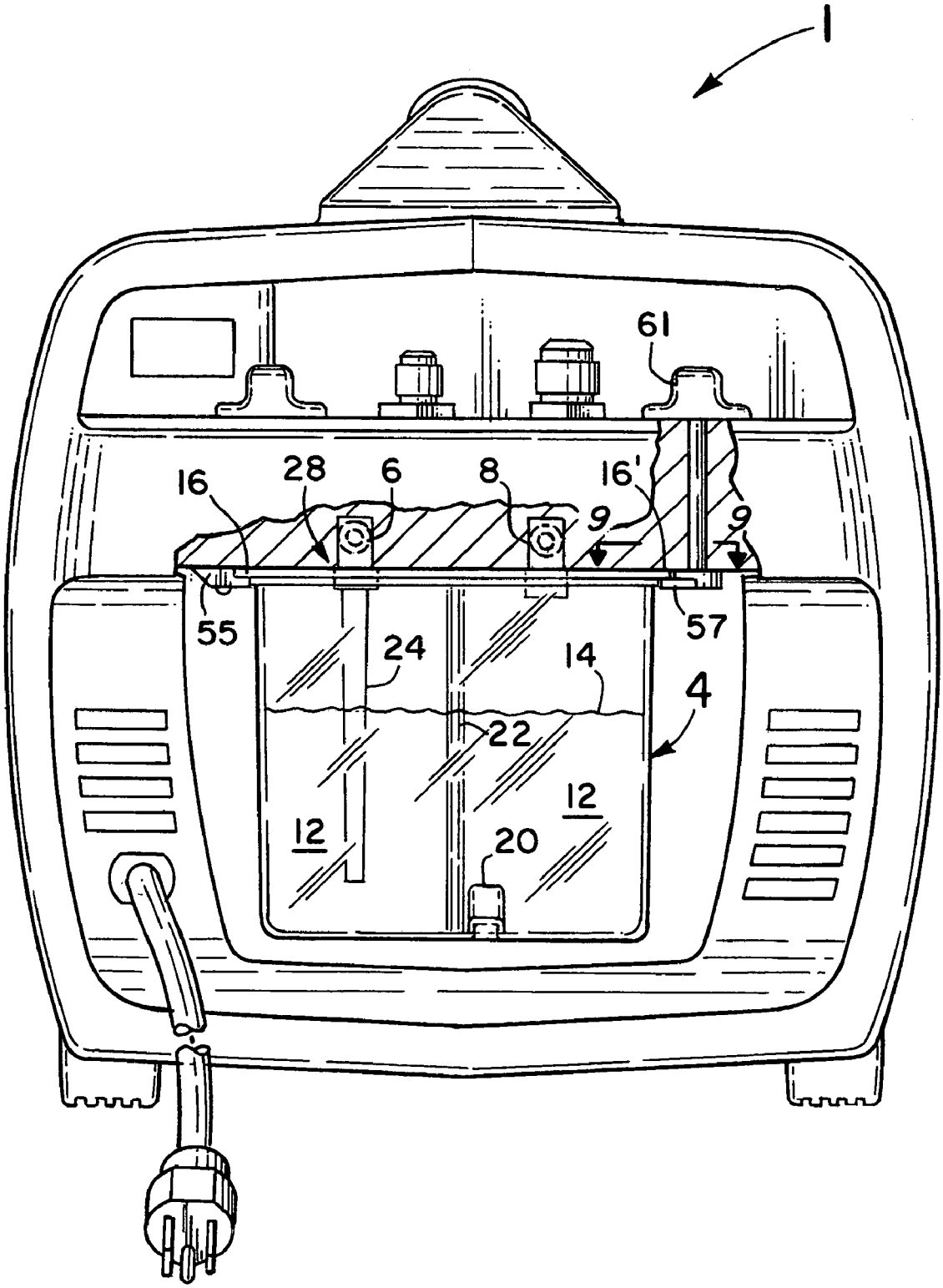
FIG. 8 is a front elevational view of the pump showing the removable, oil reservoir cartridge.

The reservoir cartridge 4 as illustrated in FIG. 8 is preferably made of substantially clear material (e.g., plastic) and is positioned in the front of the main body of the pump 1 (see also FIG. 1). The reservoir cartridge 4 can be positioned at other locations but in all of them, the reservoir cartridge 4 is preferably removably attached to the main body of the pump 1 by an easily operated, manual mechanism. In this manner and as the oil circulates through the pump 1 during a job or jobs, becomes dirty, and is collected back in the sump portion 12 of the reservoir cartridge 4, the entire reservoir cartridge 4 (including the sump portion 12 of dirty oil) can be easily and quickly removed as a unit and replaced with another reservoir cartridge with a fresh supply of clean oil. In contrast, other pumps require the operator to follow a time consuming and labor intensive procedure of draining or flushing the dirty oil from an internal sump built within the main body of the pump and pouring fresh oil into the pump.

Additionally, because the removable reservoir cartridge 4 is preferably made of clear, rigid plastic and mounted on the main body of the pump 1 to be clearly visible (FIG. 8), the operator can very easily and quickly see and monitor the condition of the oil. The entire reservoir cartridge 4 in this regard is preferably visible. This is in contrast to other pumps with only a sight glass or similar arrangement to view the oil. Such sight glasses in particular have a very limited view of the oil level in the sump. Further, such sight glasses often become caked and visually blocked with a film of the dirty oil circulating in the pump essentially rendering them useless.

The reservoir cartridge 4 of the present invention as illustrated in FIGS. 8-12 can be removably attached to the main body of the pump 1 in any number of easily operable, manual arrangements. As for example as shown in FIGS. 8-11, the reservoir cartridge 4 can be provided with lips 16,16' with the one lip 16 received in an L-shaped bracket 55 (FIG. 8) and the other lip 16' captured by an eccentric, locking piece 57. To remove the reservoir cartridge 4, the eccentric locking piece 57 can be manually rotated by manipulating the knob 61 (FIGS. 8 and 11) to release the lip 16'. The reservoir cartridge 4 can then be manually tilted or cocked downwardly as in FIG. 11 and moved to the right in FIG. 11 to release the opposing lip 16 from the L-shaped bracket 55. The removed reservoir cartridge 4 can thereafter be cleaned and refilled but preferably is completely replaced with a second reservoir cartridge 4 with a fresh supply of oil.

In the embodiment of FIG. 12, the reservoir cartridge 4 is shown being removably attached to the main body of the pump 1 by a simple and flexible, L-shaped clip 63. The reservoir cartridge 4 could also be attached to the main body of the pump 1 by a simple, threaded or screw attachment.

In the illustrated embodiments, substantially all of the oil in the pump 1 including its lubricating system is returned to and contained in the sump portion 12 of the reservoir cartridge 4 when the pump 1 is stopped. In this manner and when the reservoir cartridge 4 is replaced with a second one with fresh oil, substantially all of the oil in the pump 1 of the present invention will also be replaced. However, sump portion 12 of the removable reservoir cartridge 4 could be used in conjunction with a larger sump configuration including one with a built-in sump section within the main body of the pump 1 and not removable. The replacement reservoir cartridge 4 would then not replace substantially all of the oil of the pump 1 at once. Rather, only a part of the oil would be replaced each time but even then, the replacement amount would preferably be at least a significant amount of the total volume of oil. Otherwise, the oil would always have significant portions of used oil that can be detrimental to the depth of vacuum that can be drawn. In any event and with the replaceable reservoir cartridge 4 of the present invention, the time consuming and labor intensive procedures of gravity draining or flushing out the used oil of other pumps and pouring in fresh oil are avoided.

The reservoir cartridge 4 as discussed above is preferably made of clear plastic and supported in clear view on the main body of the pump 1. Consequently, a visual indicator such as 20 in FIG. 8 of the condition of the oil can be provided within the reservoir cartridge 4 (e.g., on the bottom of the sump portion 12). In the illustrated embodiment of FIGS. 8 and 11, the visual indicator 20 is shown on the section of the sump portion 12 on the right side of the perforated barrier 22. The sump portion 12 in this regard extends entirely across the reservoir on both side of the perforated barrier 22. The purpose of the perforated barrier 22 is to prevent any undesirably large particles (e.g., wear shavings) or other material in the returned oil from passing to the left side of the sump portion 12. In this regard, it is from this left side that oil is drawn up through the tube 24 into the line 6 leading to the bore of the housing 7 of FIG. 3. The right side of the sump portion 12 would then tend to have the dirtiest oil for monitoring by the visual indicator 20.

In any event and regardless of whether the visual indicator 20 is on the right or left side of the perforated barrier 22, the illustrated indicator 20 (FIGS. 13-15) has an inclined surface 26 slanting upwardly from the front of the reservoir cartridge 4. As the oil is used and darkens, the letters A-E or other markings on the inclined surface 26 become progressively harder to read (compare FIGS. 13 and 14) letting the operator know the condition of the oil and that the reservoir cartridge 4 may need to be removed and replaced. Other visual indicators could also be used with the clear plastic, reservoir cartridge 4. However, because substantially the entire reservoir cartridge 4 including its sump portion 10 is visible to the operator, the visual indicator 20 can be positioned at the bottom of the sump portion 12 giving a preferred reading of the condition of the returning oil.

Figure 16:
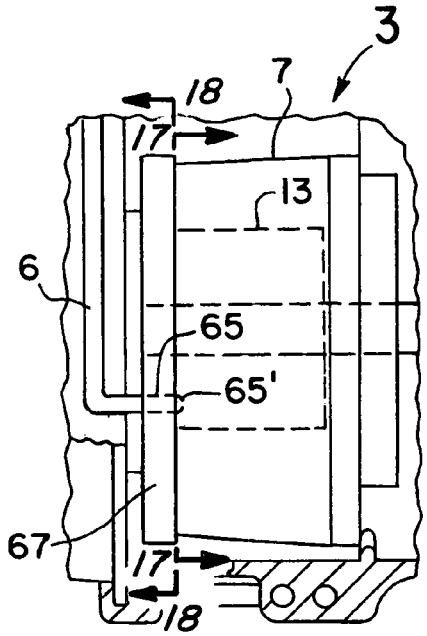
FIGS. 16-18 illustrate one manner in which the oil can be introduced into the bore of the pump housing.
Figure 17:
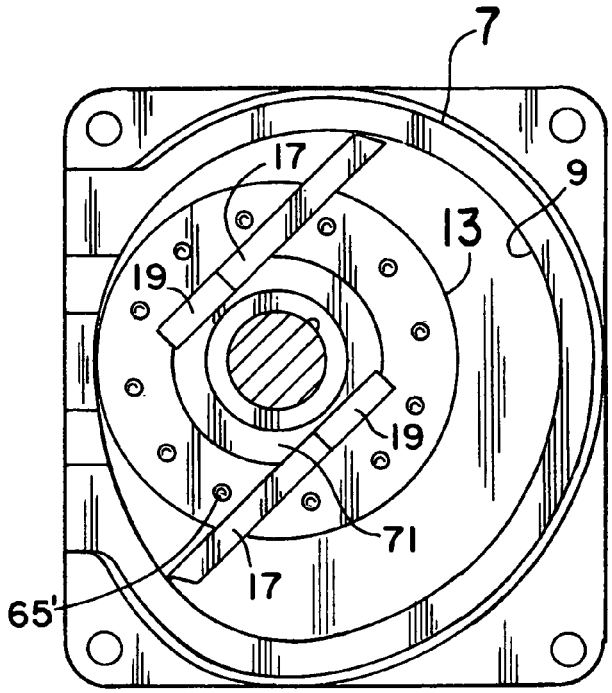
Figure 18:
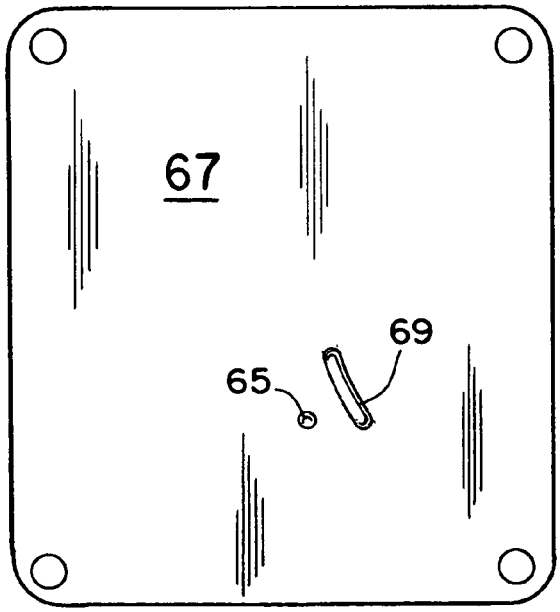

The removable and replaceable reservoir cartridge 4 has a sealing engagement at 28 (see FIGS. 8 and 11) between the outlet 30 of the depending tube 24 and the inlet 32 (FIG. 11) to the line 6 leading to the housing 7 of FIG. 3. The tube 24 (FIG. 8) then extends downwardly below the oil level 14 in the sump portion 12 and the vacuum generated by the rotor 13 will draw metered amounts of oil into the tube 24 and through line 6 to the bore of the housing 7. In a known manner as illustrated in FIGS. 16-18, oil drawn through the line 6 of FIGS. 2 and 3 from the sump portion 12 of the reservoir cartridge 4 can be delivered from the end 65 of the line 6 into each passing dimple 65' (FIGS. 16 and 17) in the side of the rotor 13. Each dimple 65' then moves along the stationary housing wall 67 of FIGS. 16 and 18 until the filled dimple 65' of FIG. 16 aligns with the groove 69 in the housing wall 67 of FIG. 18. The oil thereafter passes from the filled dimple 65' into the groove 69 of FIG. 18 and inward along the groove 69 to connect with the recessed channel 71 (FIG. 17) extending about the side of the rotor 13. From there, the oil enters the vane slots 19 and moves outwardly around the vanes 17 and into the bore of the housing 7. It is noted that the bore of the housing 7 is defined in part by the illustrated portion of the inner surface 9 extending about the housing axis 11 in FIG. 3. The inlet and outlet passages 31 and 33 are then shown in FIG. 3 as being ported at 35 and 37 through this portion of the inner surface 9. However, the ports could also pass through the inner surface of the housing end walls including 67 forming the remainder of the inner surface 9 defining the bore in the housing 7.

Figure 19:
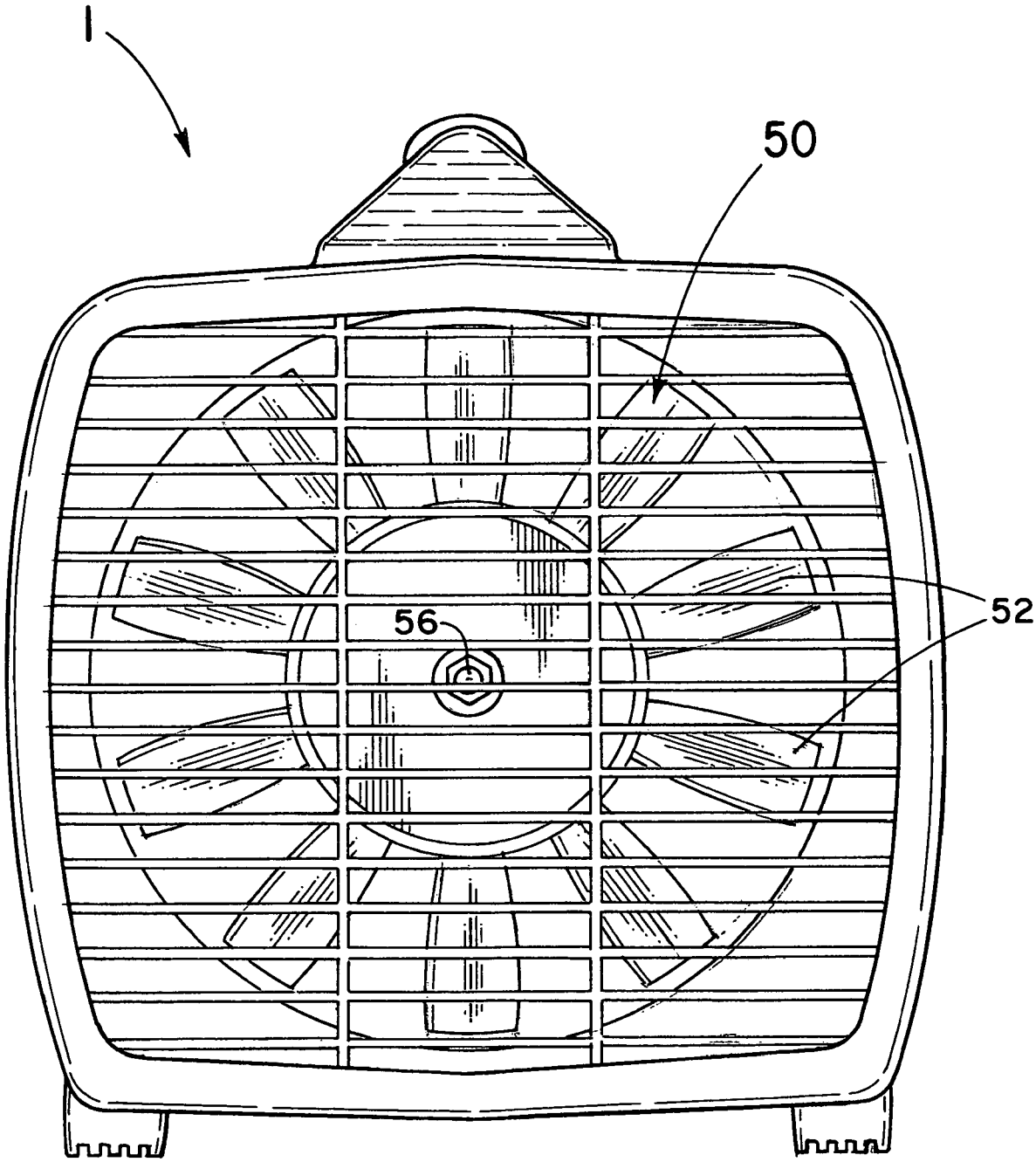
FIG. 19 is a rear view of the portable pump taken along line 19-19 of FIG. 2 and showing the cooling fan.
Figure 20:
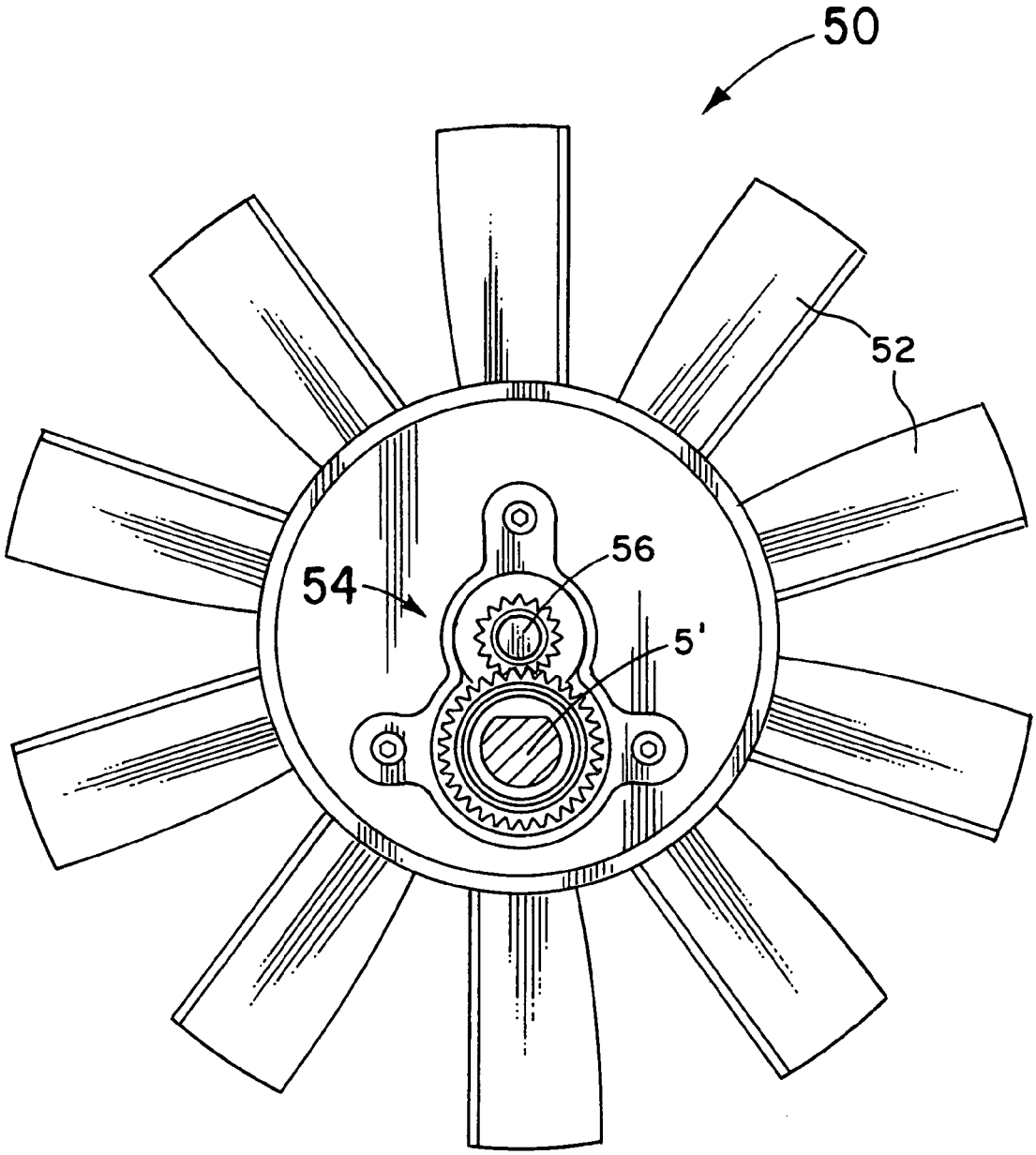
FIG. 20 is a view taken along line 20-20 of FIG. 2 illustrating the step up gearing arrangement for the cooling fan.
Figure 21:
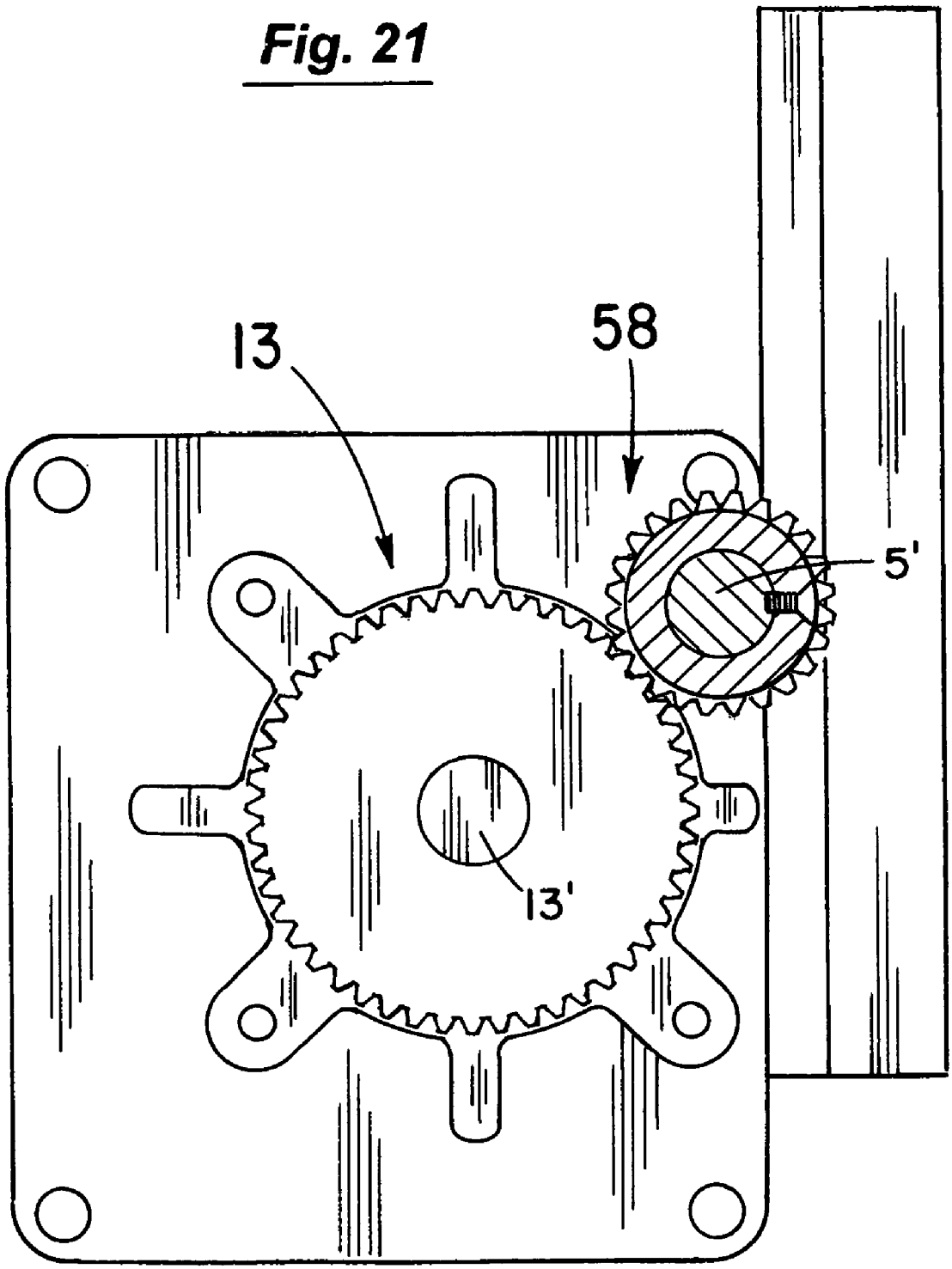
FIG. 21 is a view taken along line 21-21 of FIG. 2 illustrating the step down gearing arrangement for the rotary vane pump.

The portable pump 1 preferably includes a cooling fan 50 as illustrated in FIG. 19 (which is a rear view taken along line 19-19 of FIG. 2). The fan 50 has a plurality of relatively large blades 52 (FIG. 20) and is driven from the drive shaft 5' of the motor 5 of FIG. 2 through a step up gearing arrangement 54 (FIG. 20). In operation, the drive shaft 5' is driven by the motor 5 at a first rate of revolution (e.g., 1700 revolutions per minute) and the step up gearing arrangement 54 rotates the driven shaft 56 of the fan 50 at a substantially greater rate (e.g., 3000 revolutions per minute up to about twice the rate of shaft 5' or more). This creates a relatively large volume of cooling air (e.g., 300 cubic feet per minute) directed through the main body of the pump 1 to cool its parts including the motor 5 and pump unit 3. Additionally, the pump 1 of the present invention includes a step down gearing arrangement 58 (see FIGS. 2 and 21) between the drive shaft 5' of the motor 5 and the driven shaft 13' of the rotor 13. The rate of revolution of the driven shaft 13' of the rotor 13 is then substantially less (e.g., 800-1200 revolutions per minute down to about half or more of the rate of the motor drive shaft 5'). The rotary vane pump 3 will then last longer and run cooler than if it were driven at the same or nearly the same rate as the motor 5. The cooler running pump 3 then need not be submerged in a sump as in other designs. The combination of the step up gearing of the fan 50 and the step down gearing of the rotary vane pump 3 is particularly advantageous in the portable unit of the present invention which is often operated outside (e.g., on roof tops) in extremely hot, ambient air temperatures. In such conditions, other units can become quickly overheated and shut down. However, the present unit is specifically designed as discussed above to better handle such extreme conditions. Also, it is specifically noted that the step up gearing arrangement 54 for the fan 50 has applications in other portable pump units including refrigerant recovery ones.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A portable, rotating vane vacuum pump for evacuating a system to a pressure substantially below ambient pressure, said portable vacuum pump including:

a housing having an inner surface with at least a portion thereof extending about a first axis and defining in part a bore, a rotor mounted within said bore for rotation about a second axis offset from and substantially parallel to said first axis, said rotor further including at least two vanes mounted for sliding movement within respective slots in said rotor, a motor to rotate said rotor in a first rotational direction about said second axis within said bore, said vanes having inner and outer edge portions with the outer edge portions being in contact with the inner surface of said housing as said rotor is rotated by said motor about said second axis within said bore separating said bore into a plurality of chambers with at least one of said chambers being at a pressure less than ambient pressure, said housing further including at least one inlet passage and at least one outlet passage through the inner surface in respective fluid communication with said bore, said inlet passage being in fluid communication with the system to be evacuated below ambient pressure, a lubricating oil system with a removable oil reservoir cartridge open to atmosphere and at ambient pressure, an oil inlet arrangement to supply oil from said reservoir cartridge to the bore of said housing to at least said one chamber while said motor is rotating said rotor and while said oil reservoir is open to atmosphere, said one chamber being at said pressure less than ambient pressure and said oil being drawn into said one chamber wherein the supplied oil is at ambient pressure prior to being drawn via the oil inlet arrangement into the one chamber at less than ambient pressure, and an oil return arrangement to deliver oil back from said bore in said housing to said reservoir cartridge, said oil return arrangement being vented to ambient air downstream of said housing wherein the delivered oil enters the reservoir cartridge at ambient pressure, said reservoir cartridge forming at least a portion of a sump for said oil being delivered by said return arrangement from the bore of said housing wherein substantially all of the oil in said portable vane pump including in the lubricating system thereof is contained in said reservoir cartridge, said portable vane pump having a main body and said reservoir cartridge including said sump portion thereof being removably attached to the main body of said portable vane pump by a manually operable arrangement wherein said reservoir cartridge including the sump portion thereof can be manually removed from the main body of the portable vane pump as a unit with substantially all of the oil in said portable vane pump including the lubrication system thereof contained in the removed reservoir cartridge.

2. The portable vacuum pump of claim 1 wherein substantially all of said removable reservoir cartridge including the sump portion thereof is made of substantially clear, rigid material.

3. The portable vacuum pump of claim 2 further including a visual indicator of oil condition within the sump portion of the clear reservoir cartridge.

4. The portable vane pump of claim 1 wherein substantially all of the oil being delivered back from said bore by said return arrangement is received in the sump portion of said removable reservoir cartridge.

5. The portable vane pump of claim 1 further including a second oil reservoir removably attachable to said portable vane pump by said manually operable arrangement and filled with a volume of oil substantially the same as the volume of oil in the removed first mentioned oil reservoir wherein said first mentioned reservoir cartridge including the sump portion thereof containing oil delivered by said return arrangement from said bore and substantially all of the oil in the portable vane pump including the lubricating system thereof can be manually removed as a unit and replaced with said second reservoir cartridge.

6. The portable vane pump of claim 1 wherein said reservoir cartridge has an oil outlet removably and sealingly engaging the oil inlet arrangement supplying oil from the reservoir cartridge to the bore of said housing.

7. The portable vane pump of claim 6 wherein said reservoir cartridge has an inlet to receive oil from said oil return arrangement.

8. The portable vane pump of claim 7 wherein said inlet is in fluid communication with ambient air.

9. The portable vane pump of claim 8 wherein said return arrangement includes a downwardly inclined conduit leading to the inlet of said reservoir cartridge whereby the oil in said return arrangement flows by gravity into the inlet into said reservoir cartridge.

10. The portable vane pump of claim 7 wherein said return arrangement includes a downwardly inclined conduit leading to the inlet of said reservoir cartridge whereby the oil in said return arrangement flows by gravity to the inlet and into said reservoir cartridge.

11. A portable, rotating vane vacuum pump for evacuating a system to a pressure substantially below ambient pressure, said portable vacuum pump including:

a housing having an inner surface with at least a portion thereof extending about a first axis and defining in part a bore, a rotor mounted within said bore for rotation about a second axis offset from and substantially parallel to said first axis, said rotor further including at least two vanes mounted for sliding movement within respective slots in said rotor, a motor to rotate said rotor in a first rotational direction about said second axis within said bore, said vanes having inner and outer edge portions with the outer edge portions being in contact with the inner surface of said housing as said rotor is rotated by said motor about said second axis within said bore separating said bore into a plurality of chambers with at least one of said chambers being at a pressure less than ambient, said housing further including at least one inlet passage and at least one outlet passage through the inner surface in respective fluid communication with said bore, said inlet passage being in fluid communication with the system to be evacuated below ambient pressure, a lubricating oil system with a removable oil reservoir cartridge open to atmosphere and at ambient pressure, an oil inlet arrangement to supply oil from said reservoir cartridge to the bore of said housing to at least said one chamber while said motor is rotating said rotor and while said oil reservoir is open to atmosphere, wherein said supplied oil is at ambient pressure prior to being drawn into said chamber, and an oil return arrangement to deliver oil back from said bore in said housing to said reservoir cartridge, said oil return arrangement being vented to ambient air downstream of said housing wherein the delivered oil enters the reservoir cartridge at ambient pressure, said reservoir cartridge forming at least a portion of a sump for said oil being delivered by said return arrangement from the bore of said housing, said portable vane pump having a main body and said reservoir cartridge including said sump portion thereof being removably attached to the main body of said portable vane pump by a manually operable arrangement wherein said reservoir cartridge including the sump portion thereof can be manually removed from the main body of the portable vane pump as a unit and wherein substantially all of said removable reservoir cartridge including the sump portion thereof is made of substantially clear, rigid material.

12. The portable vacuum pump of claim 11 further including a visual indicator of oil condition within the clear sump portion of the clear reservoir cartridge.

13. The portable vacuum pump of claim 11 wherein substantially all of the oil in said portable vane pump including in the lubricating system thereof is contained in said clear reservoir cartridge and substantially all of said oil in said reservoir cartridge is visible through the clear material of said reservoir cartridge.

* * * * *